US007520525B2

(12) United States Patent
Ableidinger et al.

(10) Patent No.: US 7,520,525 B2
(45) Date of Patent: Apr. 21, 2009

(54) GLIDING BOARD, IN PARTICULAR A SKI

(75) Inventors: Anton Ableidinger, Kleinstetteldorf (AT); Henry Freisinger, Vienna (AT); Erwin Hoesl, Hundsheim (AT); Marc Humann, Breitenbrunn (AT); Gernot Jahnel, Katzelsdorf / Eichenbüchel (AT); Robert Pfaller, Vienna (AT); Manfred Tuma, Enzersdorf/F. (AT); Johann Zotter, Vienna (AT)

(73) Assignee: Tyrolia Technology GmbH, Schwechat (AT)

( * ) Notice: Subject to any disclaimer, the term of this patent is extended or adjusted under 35 U.S.C. 154(b) by 186 days.

(21) Appl. No.: 11/056,940

(22) Filed: Feb. 11, 2005

(65) Prior Publication Data

US 2005/0179234 A1 Aug. 18, 2005

(30) Foreign Application Priority Data

Feb. 11, 2004 (AT) ..... GM 100/2004

(51) Int. Cl.
*A63C 5/00* (2006.01)

(52) U.S. Cl. ..... 280/607

(58) Field of Classification Search ..... 280/601, 280/607, 609, 617, 618, 14.22
See application file for complete search history.

(56) References Cited

U.S. PATENT DOCUMENTS 3,977,688 A * 8/1976 Imagawa ..... 280/633
5,016,901 A * 5/1991 Mayr ..... 280/607
5,197,752 A * 3/1993 Engelbert et al. ..... 280/610
6,102,428 A * 8/2000 Bobrowicz ..... 280/607
6,641,162 B2 11/2003 Allmann et al.
2003/0102651 A1 6/2003 Riepler

FOREIGN PATENT DOCUMENTS

| | | | |
|---|---|---|---|
| EP | 1 161 972 A2 | | 12/2001 |
| EP | 1 380 323 A1 | | 1/2004 |
| FR | 1.282.053 | | 12/1961 |
| FR | 2 704 155 A1 | | 10/1994 |
| FR | 2791268 | * | 9/2000 |
| WO | WO 01/45810 A1 | | 6/2001 |

OTHER PUBLICATIONS

Austria Patent Office Search Report dated Oct. 25, 2004 (2 pages).

* cited by examiner

*Primary Examiner*—Frank B Vanaman
(74) *Attorney, Agent, or Firm*—Flynn, Thiel, Boutell & Tanis, P.C.

(57) ABSTRACT

A sliding board, in particular a ski, includes a running surface, steel edges, an upper cup, a premanufactured core and at least one interface element connected to the sliding-board body by anchoring elements, for the arrangement of at least one binding element on the upper side of the sliding board. The anchoring elements have a head section held on the interface element or connected to the interface element, and have a shaft extending through an opening in the upper cup into the inside of the sliding board. In order to reduce installation operations on the finished sliding board, the interface element has been connected to the core during the building of the sliding board by at least one of the anchoring elements.

7 Claims, 5 Drawing Sheets

GLIDING BOARD, IN PARTICULAR A SKI

FIELD OF THE INVENTION

The invention relates to a gliding board, in particular a ski, comprising a running surface, steel edges, an upper cup, a prefabricated core, and comprising at least one interface element, for example a rail-like profiled guide element, which is connected to the sliding-board body by means of anchoring elements, for arrangement of at least one binding element on the upper side of the sliding board, whereby the anchoring elements have a head section held on the interface element or are connected to the interface element, and have a shaft extending through an opening in the upper cup into the inside of the sliding board.

BACKGROUND OF THE INVENTION

A sliding board with a profile-rail system is known from the EP 1 161 972 A1, which system consists of at least one rail extending in longitudinal direction of the sliding board, which rail is connected to the sliding-board body through at least one attached peg or peg section via a peg connection or peg anchoring. According to a preferred embodiment the profile rail is fastened in bores fittingly provided on the sliding-board body, into which bores expanding pegs are inserted and into the center bores of which bolts are pressed or driven while expanding. Thus the fastening of the profile rails occurs on the finished sliding board and replaces merely the otherwise common screw fastening. In order to make available a sliding board with an already premounted profile-rail system, it is therefore necessary to carry out fastening and installation operations on the finished sliding board.

SUMMARY OF THE INVENTION

The basic purpose of the invention is to make a sliding board available, in which profile-rail systems or other interface elements are connected to the body of the ski in such a manner that no subsequent fastening and installation operations on the finished sliding board are any longer necessary.

The set purpose is attained inventively by the interface element having been connected positively and/or frictionally and/or in another mechanical manner to the core during the building of the sliding board by means of at least one of the anchoring elements.

Thus the interface elements, which create the connection to the binding parts, for example a front jaw or a heel jaw of a ski binding, are bound or integrated during the manufacture of the sliding board or of the ski into the design of the same. Thus a separate fastening of the interface element on the finished sliding board is no longer necessary.

Sliding boards, in particular skis, which are designed according to the invention can be manufactured in a rational and technically simple manner. It is advantageous in this connection when the anchoring element has been connected to the upper cup prior to the positioning of the core. As an alternative to this it is possible for the anchoring element to be connected to a locking part held, in particular, foamed into the core.

Such a connection can be created in a simple manner by the shaft of the anchoring element having a recess, into which the locking part extends.

Another inventive modification provides that the shaft of the anchoring element is spread apart from below and is inserted into an opening of the locking part, which opening extends through the core. A different modification provides that a wedge part is inserted into the shaft of the anchoring element so that the anchoring element is held on the upper cup prior to the positioning of the core.

In the place of a wedge part it is possible for the shaft to be provided with a part screwed in from below or to be designed as such a part attachable in this manner.

A different modification provides that the shaft of the anchoring element is held on the upper cup like a rivet. Other inventive modifications each provide an intermediate part, which is designed in particular annularly or the like, and which is mounted on the shaft or on the screwed-in part.

The anchoring element is in a different embodiment of the invention held on the upper cup by means of a locking part. A design is particularly advantageous where the locking part has a keyhole-like or similarly designed opening in order to receive the shaft of the anchoring element, whereby the narrower opening section engages the shaft in the area of a local contraction. Also this design makes possible a simple and rational manufacture of the sliding board or ski.

The opening in the upper cup is in a further embodiment divided keyhole-like into two opening sections, which have different diameters, whereby also in the case of this modification the narrower section engages the shaft in the area of a local contraction.

BRIEF DESCRIPTION OF THE DRAWINGS

Further characteristics, advantages and details of the invention will now be described in greater detail in connection with the drawings, which illustrate exemplary embodiments and in which.

DETAILED DESCRIPTION OF THE INVENTION

Figure 1:
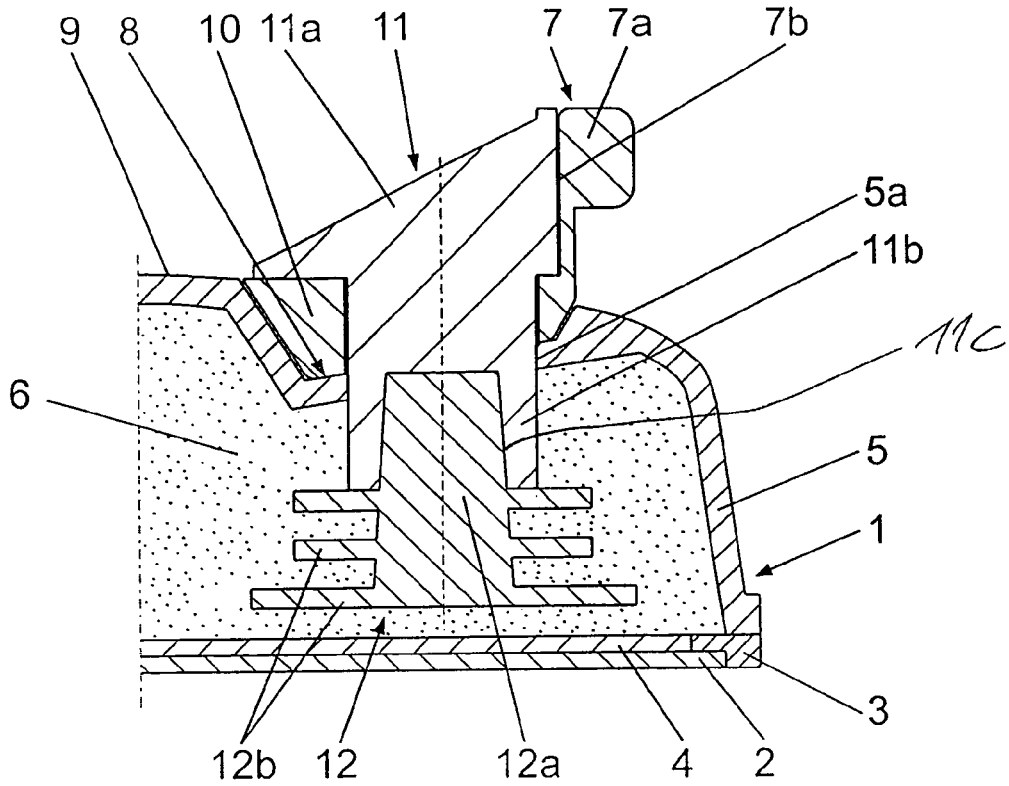
FIG. 1 is a partial cross-sectional view of a gliding board according to a further embodiment of the invention.

The figures in the drawings illustrate different embodiments of the invention, whereby the exemplarily illustrated ski 1 has in all illustrations as the main parts a core 6, an upper cup 5 (5' in FIG. 10) forming and enveloping the upper side and the two longitudinal sides of the ski 1, which cup can be designed in one layer or multilayered, a running surface 2, edges 3 consisting of steel (not illustrated in FIG. 10) and a lower belt 4 between the running surface 2 and the core 6. Further intermediate layers, for example an upper belt, can be inserted between the upper cup 5 and the core 6. The ski 1 has recesses 8 at least in those areas, where rail-like profiled guide elements 7, of which in each case only the one is illustrated, are arranged in pairs. A raised section 9 is provided between said recesses 8. The rail-like profiled guide elements 7 with at least essentially fittingly designed foot sections 10 sit in the recesses 8. The pair of rail-like profiled guide elements 7 is provided for arranging, guiding, slidingly movable shifting and the like of a ski binding or a ski-binding part—for example, a front jaw and a heel jaw of a safety ski binding.

Each guide element 7 has for this purpose on the section facing the adjacent ski side surface a guide bar 7*a* extending in longitudinal direction of the ski so that, for example, a base or support plate of a ski binding or of a ski-binding part can be moved onto the pair of guide elements 7 and can be fixed in longitudinal direction of the ski relative to the ski by not illustrated measures or mechanisms. Each guide element 7 has at least two, in particular, however, more than two receiving points 7*b* for insertion and passage of anchoring elements 11, by means of which the guide elements 7 are connected to the ski 1 already during the manufacture thereof. The figures in the drawings show various possibilities of the connection, which will be described in greater detail hereinafter.

The anchoring element 11 in the embodiment illustrated in FIG. 1 consists of a head 11*a* sitting and supported in the receiving point 7*b* and of a shaft 11*b* attached to said head and projecting out of the guide element 7, which shaft is of a cylindrical shape and has centrally a comparatively wide gap 11*c* becoming wider toward the end of the shaft.

The core 6 of the ski 1 is a prefabricated core, which is at least partially, in particular totally, manufactured out of foam. Retaining parts 12, which can be assembled with the anchoring elements 11, are foamed into the foam material. Each retaining part 12 has a mounting part 12*a*, which is freely positioned in the foam material so that the shaft 11*b* of the anchoring element 11 can be mounted with its gap 11*c* on the retaining part 12. The blocking parts 12 are thereby fixedly anchored in the foam material, for example, by a number of anchor parts or anchor arms 12*b* embedded in the foam material.

The rail-like profiled guide elements 7 are during the manufacture of the ski 1 positioned on the already preformed upper cup 5, the anchoring elements 11 positioned on the guide elements 7 are placed through openings 5*a* of the upper cup 5, the core 6 is positioned by placing or pressing the shafts 11*b* of the anchoring elements 11 onto the mounting parts 12*a* of the retaining parts 12. The ski 1 is completed with its further components and is molded in a form by adding pressure and heat. In case further layers are built in below the upper cup 5, these are also provided with corresponding openings for passage of the anchoring elements 11.

Figure 2:
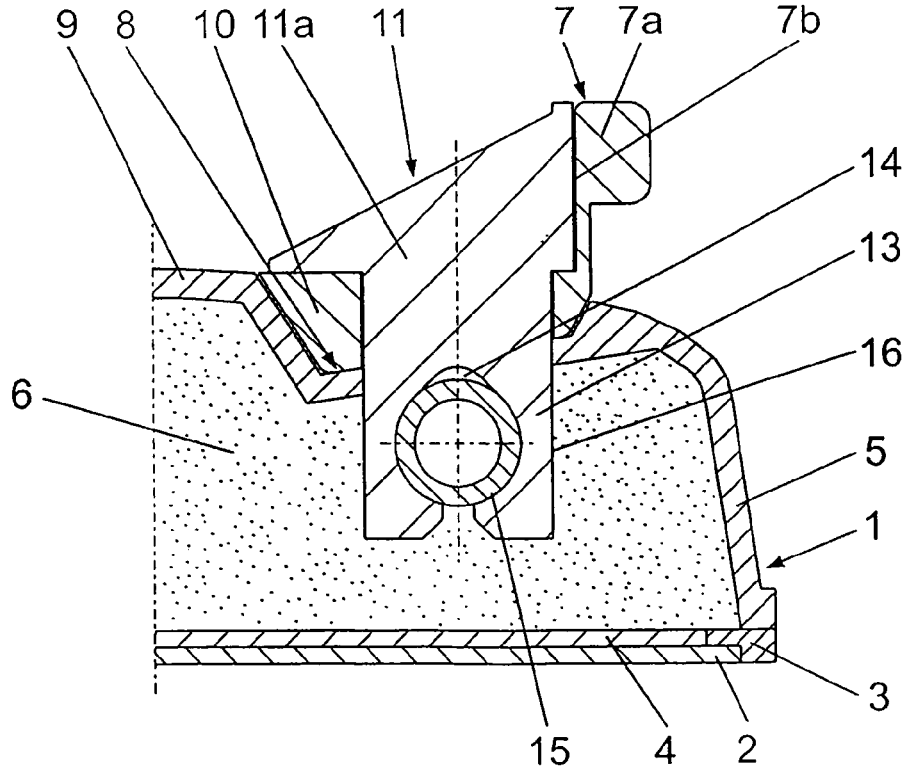
FIG. 2 is a partial cross-sectional view of a gliding board according to a further embodiment of the invention.

The anchoring elements 11 are in the embodiment according to FIG. 2 provided with a shaft 13, which has a recess 14, into which a wedge part 15 can be inserted from below by expanding the shaft 13. The recess 14 is designed round in the illustrated embodiment in order to receive a round, for example, tube-shaped wedge part 15. The foam core 6 is manufactured or provided with recesses 16 in order to receive the shafts 13 of the anchoring elements 11. The rail-like profiled guide elements 7 are during the manufacture of the ski, analogous to the embodiment according to FIG. 1, positioned on the upper cup 5 by means of the anchoring elements 11, the wedge parts 15 are snapped into the recesses 14 of the shafts 13, and the shafts 13 of the anchoring elements 11 are inserted or pressed into the recesses 16 in the core 6. The ski 1 is completed and is molded in a form by adding pressure and heat.

Figure 3:
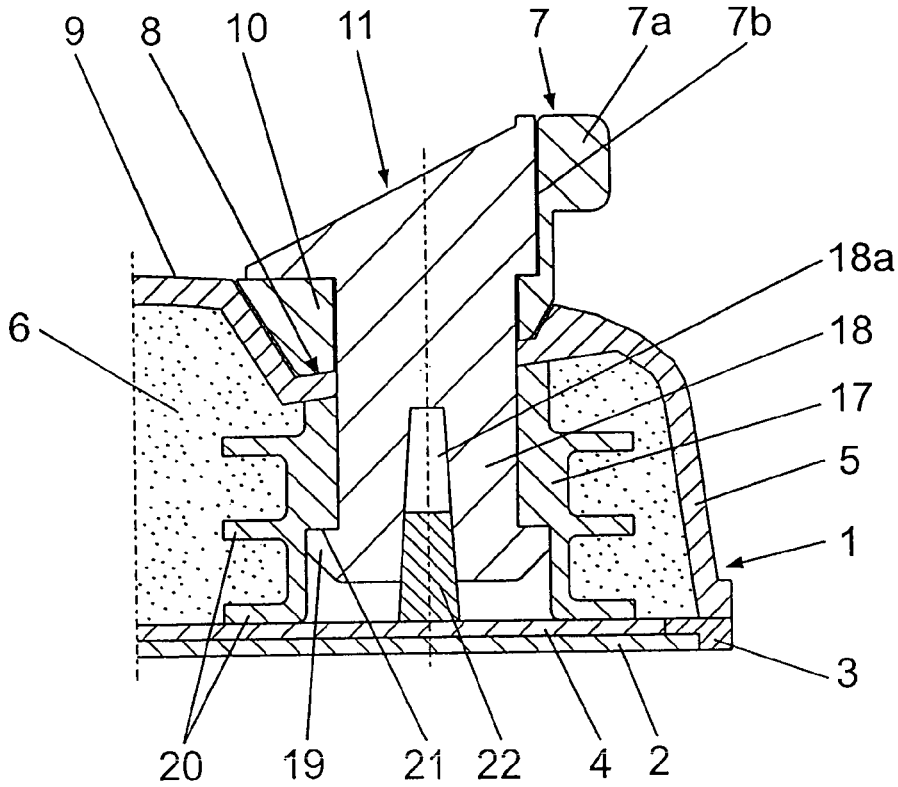
FIG. 3 is a partial cross-sectional view of a gliding board according to a further embodiment of the invention.

FIG. 3 illustrates an embodiment, in which, similar to FIG. 1, a retaining part 17 for the anchoring element 11 has been bound in during foaming of the core 6. The shaft 18 of the anchoring element 11 is designed slotted and can be spread apart.

The end sections of the two shaft parts separated from one another by the center slot 18*a* continue hook-like outwardly. The retaining part 17 bound in the foam material through anchor parts 20 is designed sleeve-shaped so that it has a central through opening. The rail-like profiled guide elements 7 are during the manufacture of the ski 1 positioned on the preformed upper cup 5 by means of their anchoring elements 11. The, anchoring elements 11 are connected to the core 6 by inserting the shaft 18 into the sleeve-like retaining part 17, whereby the hooks 19 snap in under shoulders 21. A wedge 22 is inserted and driven from below into the slot 18*a*. The ski 1 receives the remaining components and, as mentioned, is finished.

Figure 4:
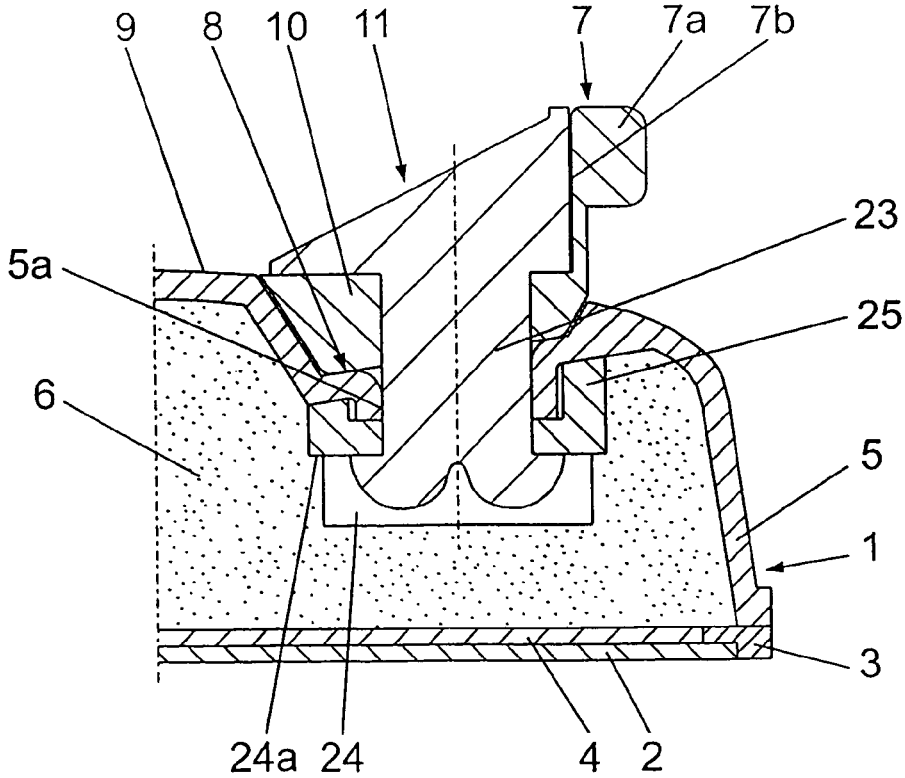
FIG. 4 is a partial cross-sectional view of a gliding board according to a further embodiment of the invention.

The shaft 23 of the anchoring element 1 is in the embodiment illustrated in FIG. 4 anchored like a rivet. The shaft 23 is for this purpose designed expandable by means of a slot. A recess 24 is provided in the core 6 in order to receive the anchoring element 11, which recess has already been formed during the manufacture of the core 6 or has been manufactured subsequently. The recess 24 has a shoulder 24*a*, on which an in particular annular intermediate part 25 can be positioned. The intermediate part 25 consists, for example, of a plastic reinforced with fiber glass and has centrally an opening for passage of the shaft 23 of the anchoring element 11. After the rail-like profiled guide elements 7 with their anchoring elements 11 have been positioned on the upper cup 5, an intermediate part 25 is moved onto the shaft 23 of the anchoring element 11. The anchoring elements 11 are placed through openings 5*a* into the upper cup 5, on the edge sections of which openings the upper cup 5 is flanged inwardly.

The flanged edge sections of the upper cup 5 are received by open positions in the intermediate part 25. The end sections of the shaft 23 are expanded, the core 6 with its recesses 24 is correspondingly positioned, the ski is finished and is molded in a form by adding pressure and heat.

Figure 5:
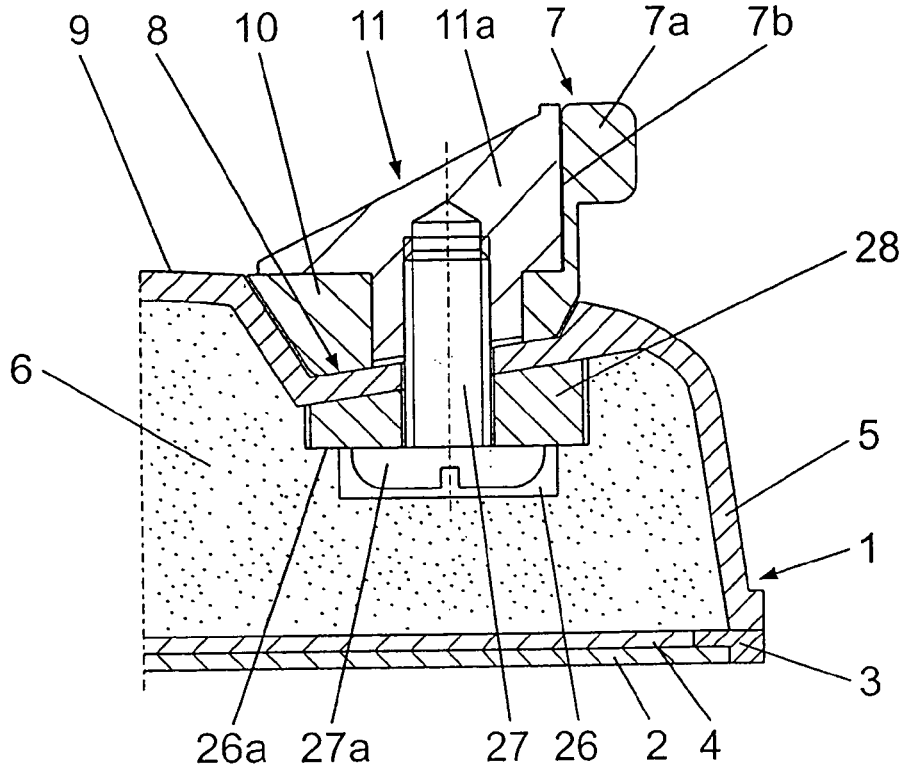
FIG. 5 is a partial cross-sectional view of a gliding board according to a further embodiment of the invention.

FIG. 5 illustrates an embodiment, in which recesses 26 are also provided in the core 6. The anchoring element 11 has a head 11*a*, into which is screwed a shaft 27 in the form of a screw with a screw head 27*a*. An intermediate part 28, which consists, for example, out of a plastic reinforced with fiber glass, can be positioned in the recess 26 on a shoulder 26*a*. The heads 11*a* are during the manufacture of the ski 1 screwed with the interpositioning of each one intermediate part 28 to the shafts 27 on the rail-like profiled guide elements 7, which are positioned on the upper cup 5, the foam core 6 is subsequently positioned, the ski 1 is completed with its further components and is molded in a form, as has been described.

Figure 6:
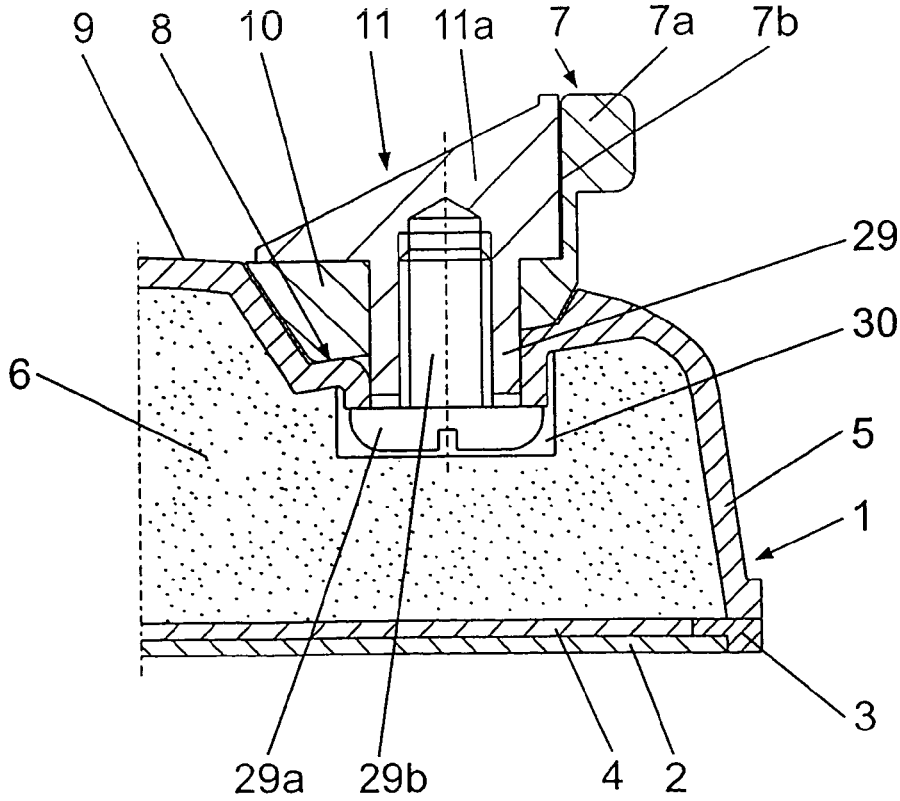
FIG. 6 is a partial cross-sectional view of a gliding board according to a further embodiment of the invention.

The embodiment, which is illustrated in FIG. 6, is similar to the embodiment according to FIG. 5. The shaft 29 of the anchoring element 11 is in this modification completed by a part 29*b*, which can be screwed on from below. A free space for flanged edge areas of the upper cup 5 is provided between the anchoring element 11 and the core 6 above the screw head 29*a*, which can be inserted into a recess 30 in the core 6. The guide elements 7 are positioned during the manufacture of the ski and the anchoring elements 11 are mounted by screwing on of the parts 29*b*, the foam core 6 is subsequently positioned, the ski is finished and subsequently molded.

Figure 7:
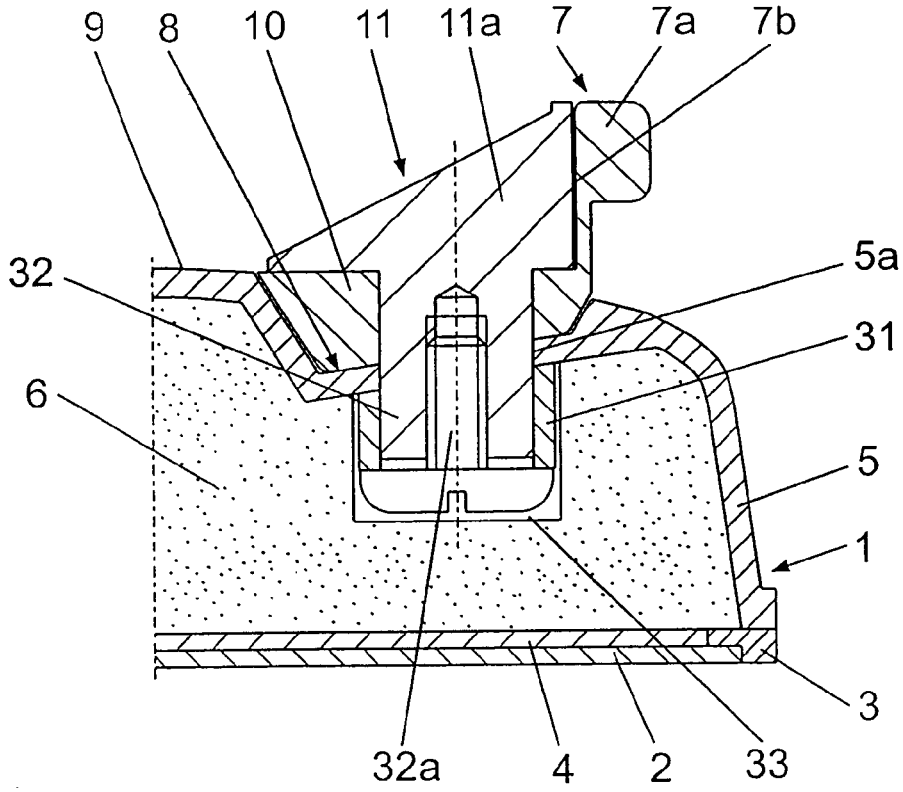
FIG. 7 is a partial cross-sectional view of a gliding board according to a further embodiment of the invention.

The embodiment illustrated in FIG. 7 corresponds essentially with the one according to FIG. 6. In the place of flanged edge sections of the upper cup 5 in the area of the holes 5*a*, an annular intermediate part 31 is provided. The rail-like profiled guide elements 7 are during the manufacture of the ski 1 positioned on the upper cup 5, an intermediate part 31 is mounted from below onto the shaft 32 of the anchoring element 11, and finally a part 32*a* is screwed to the shaft 32. The core 6 having the corresponding recesses 33 is positioned, the ski 1 is finished and molded.

Figure 8:
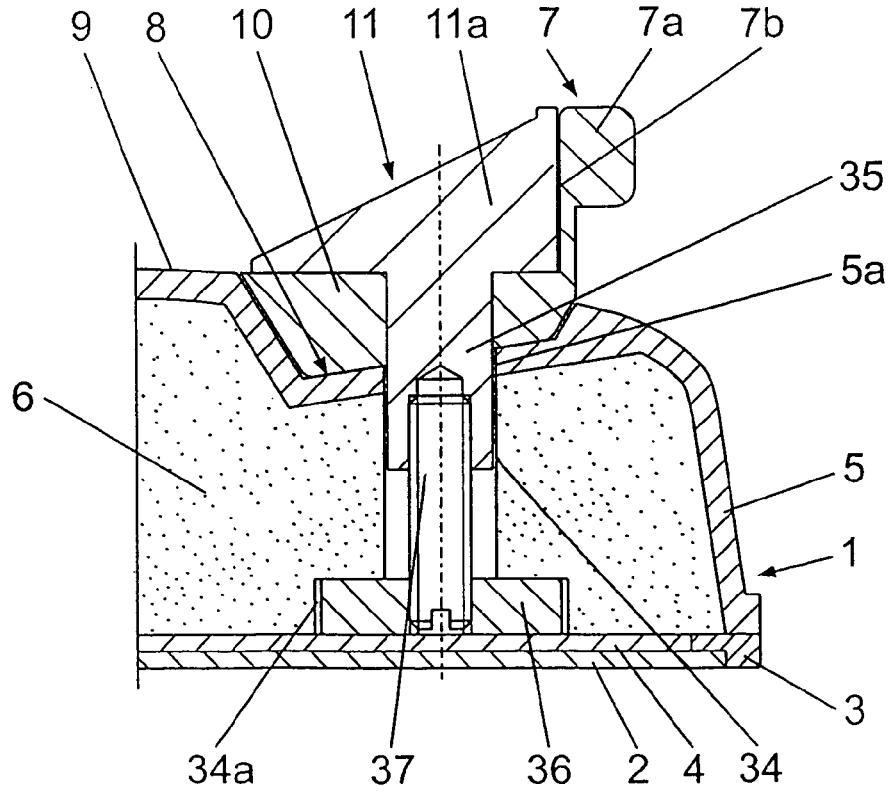
FIG. 8 is a partial cross-sectional view of a gliding board according to a further embodiment of the invention.

Through holes or bores 34 are provided in the core 6 in the embodiment illustrated in FIG. 8 in order to receive the shafts 35 of the anchoring elements 11. The end area of each hole 34, which end area is in the area of the running surface, ends into a mentioned recess 34*a* so that an annular intermediate part 36 can be inserted here, which part can be connected to the shaft 35 by a screw 37. The assembly of the individual parts is also in this embodiment very simple. The rail-like profiled guide elements 7 are positioned on the upper cup 5 by means of the anchoring elements 11, as has already been described, the core 6 is placed over the shafts 35 of the anchoring elements 11, the intermediate parts 36 are inserted into the recesses 34*a*, and the screws 37 create the connection. The ski 1 completed with the further ski components is molded.

Figure 9:
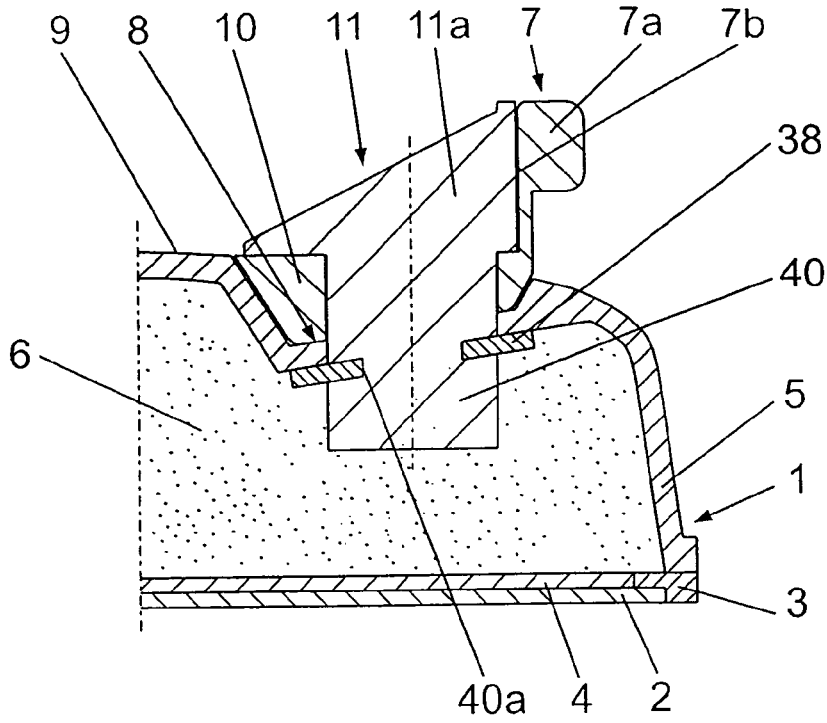
FIG. 9 is a partial cross-sectional view of a gliding board according to a further embodiment of the invention.
Figure 9A:
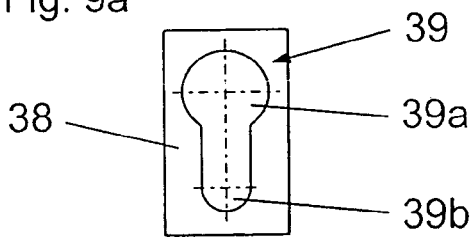
FIG. 9*a* is a plan view of a locking part according to the invention of FIG. 9.

The anchoring element 11 is in the embodiment illustrated in FIGS. 9 and 9*a* held by a locking part 38, which has an opening 39 in the form of a keyhole. FIG. 9*a* illustrates a top view of the locking part 38 with the opening 39 having two sections 39*a*, 39*b* with different diameters, which sections pass over into one another. The hole section 39*a* is sufficiently large in order to receive the shaft 40 of the anchoring element 11. The hole section 39*b* is adapted to a local contraction 40*a* in the shaft 40. When the rail-like profiled guide elements 7 are positioned on the upper cup 5 by means of the anchoring elements 11, the locking parts 38 are mounted from below by being moved each with their larger hole section 39*a* onto the shaft 40. The locking part 38 is subsequently moved such that the contraction 40*a* of the shaft 40 is positioned in the area of the hole section 39*b*. The anchoring element 11 is in this manner fixed in its position. The foam core 6, which has corresponding openings in order to receive the locking part 38 and the shaft 40, is subsequently placed, the further ski parts are correspondingly positioned, and the ski 1 is molded in a form by adding pressure and heat.

Figure 10:
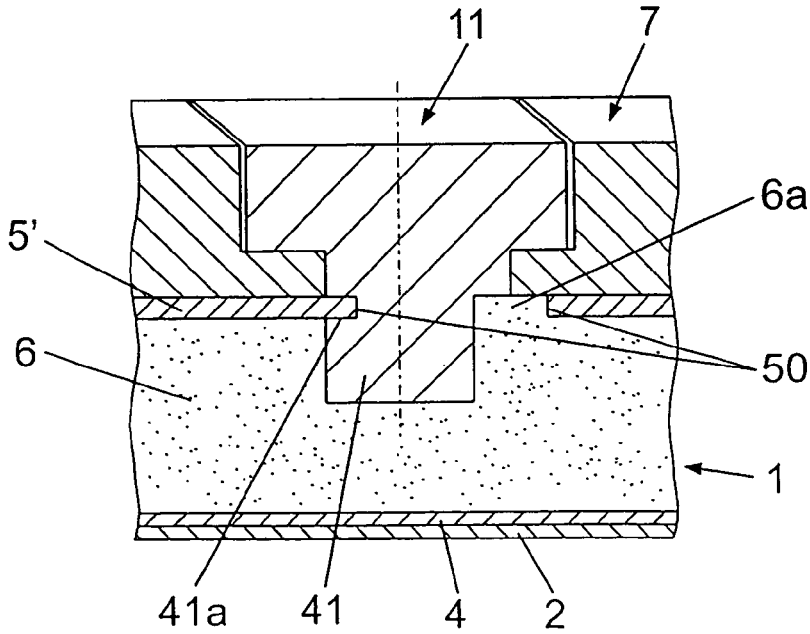
FIG. 10 is a partial cross-sectional view of a gliding board according to a further embodiment of the invention.

The opening 50 in the upper cup 5' is analogous to FIG. 9*a* divided keyhole-like into two sections having different diameters in the modification illustrated in a longitudinal cross section (longitudinal direction of the ski) in FIG. 10. The shaft 41 of the anchoring element 11 is also in this modified embodiment provided with a contraction 41*a* so that the anchoring elements 11 positioned on the rail-like profiled guide elements are first placed on the upper cup 5' through the larger sections of the holes 50, are subsequently moved in longitudinal direction of the ski so that the contractions 41*a* move into the smaller sections. The anchoring elements 11 are in the moved position secured against a vertical lifting off from the upper cup 5'. The premanufactured foam core 6, which has corresponding recesses for the anchoring elements 11, is now positioned from below. The shaft 41 is thereby received by a diametrically opposed recess. The core 6 is furthermore formed such that it has a section 6*a* in order to cover the section 5'*b* of the hole 50 in the upper cup 5'.

The invention is not limited to the illustrated embodiments. Individual measures of the embodiments can be easily combined with one another. The anchoring elements are in all illustrated embodiments parts, which are manufactured separate from the rail-like profiled guide elements 7. However, it is also possible to design the guide elements and their anchoring elements in one piece. Be it further mentioned that in place of a pair of rail-like profiled guide elements it is also possible to provide one single part, which permits a mounting of base plates, support plates and the like.

The invention claimed is:

1. A sliding board comprising a running surface, steel edges, an upper cup, a prefabricated core, and a profiled guide element for arrangement of at least one binding element on an upper side of the sliding board, the profiled guide element being secured against said upper side by at least one anchoring element, the anchoring element including a head section and a shaft, said shaft including a reduced portion and extending through an aperture in the upper cup into an interior of the sliding board, said aperture including a narrow portion and an enlarged portion, the narrow portion being configured to receive the reduced portion of the shaft of the anchoring element, and wherein the prefabricated core includes a recess shaped to receive the shaft of the anchoring element and a projection shaped to occupy an exposed portion of said enlarged portion of said aperture.

2. The sliding board according to claim 1, wherein the shaft includes a recess formed by said reduced portion, said recess having a height, and said upper cup has a wall thickness substantially equivalent to said height.

3. The sliding board according to claim 1, wherein said enlarged portion of said aperture is configured to receive a non-reduced portion of said shaft.

4. A sliding board comprising:

a running surface;

steel edges;

an upper cup having an opening therethrough into an interior of the sliding board;

a profiled guide element for arrangement of a binding element on an upper side of the upper cup;

an anchoring element having a head section and a shaft, the shaft having a major portion formed to closely conform to the opening in the upper cup, and including a reduced portion defining upper and lower parallel surfaces lying within the major portion of the shaft and defining a height, the shaft extending through the opening in the upper cup with the reduced portion positioned completely within the interior of the sliding board and the upper parallel surface coplanar with an inner surface of the upper cup;

a retaining element engaging the lower parallel surface of the reduced portion within the interior of the sliding board, the retaining element bearing against the inner surface of the upper cup to prevent removal of the anchoring element through the opening; and a core comprising a recess shaped to receive the retaining element and the portion of the shaft extending below the retaining element is positioned between the running surface and the upper cup of the sliding board.

5. The sliding board according to claim 4, wherein the anchoring element has been fixedly connected to the upper cup prior to the positioning of the core.

6. The sliding board according claim 4, wherein the retaining element comprises a flat plate having an aperture therethrough having a narrow portion and an enlarged portion, the enlarged portion being configured to receive the major portion of the shaft of the anchoring element therethrough and the narrow portion being configured to engage the reduced portion of the shaft.

7. The sliding board according to claim 4, the shaft further comprising a recess formed by said reduced portion, and said retaining element having a thickness corresponding to said height of said reduced portion and substantially occupying said recess.

* * * * *